US010078961B2

(12) United States Patent
Ruenz et al.

(10) Patent No.: US 10,078,961 B2
(45) Date of Patent: Sep. 18, 2018

(54) METHOD AND DEVICE FOR OPERATING A TRAFFIC-INFRASTRUCTURE UNIT INCLUDING A SIGNAL SOURCE

(71) Applicant: Robert Bosch GmbH, Stuttgart (DE)

(72) Inventors: Johannes Ruenz, Abstatt (DE); Berthold Kaeferstein, Moeckmuehl (DE)

(73) Assignee: ROBERT BOSCH GMBH, Stuttgart (DE)

( * ) Notice: Subject to any disclaimer, the term of this patent is extended or adjusted under 35 U.S.C. 154(b) by 25 days.

(21) Appl. No.: 15/604,245

(22) Filed: May 24, 2017

(65) Prior Publication Data

US 2018/0012487 A1 Jan. 11, 2018

(30) Foreign Application Priority Data

Jul. 5, 2016 (DE) ..... 10 2016 212 187

(51) Int. Cl.
*G08G 1/07* (2006.01)
*G08G 1/16* (2006.01)

(52) U.S. Cl.
CPC ..... *G08G 1/07* (2013.01); *G08G 1/166* (2013.01)

(58) Field of Classification Search
CPC ..... G08G 1/07; G08G 1/166
USPC ..... 340/916
See application file for complete search history.

(56) References Cited

U.S. PATENT DOCUMENTS

2013/0223686 A1* 8/2013 Shimizu ..... G08G 1/166 382/103
2017/0232888 A1* 8/2017 Ricci ..... B60Q 9/00 705/27.1

FOREIGN PATENT DOCUMENTS

DE 102013002876 B4 2/2015

* cited by examiner

*Primary Examiner* — Tanmay Shah
(74) *Attorney, Agent, or Firm* — Norton Rose Fulbright US LLP; Gerard Messina

(57) ABSTRACT

A traffic-infrastructure unit and a method for operating a traffic-infrastructure unit encompassing a signal source, the method having a step of detecting at least one vehicle, a step of detecting at least one further road user, a step of determining a danger potential for the at least one further road user due to the at least one vehicle, and a step of operating the traffic-infrastructure unit as a function of the determined danger potential.

20 Claims, 3 Drawing Sheets

METHOD AND DEVICE FOR OPERATING A TRAFFIC-INFRASTRUCTURE UNIT INCLUDING A SIGNAL SOURCE

CROSS REFERENCE

The present application claims the benefit under 35 U.S.C. § 119 of German Patent Application No. DE 102016212187.1 filed on Jul. 5, 2016, which is expressly incorporated herein by reference in its entirety.

FIELD

The present invention relates to a method and to a device for operating a traffic-infrastructure unit which includes a signal source. At least one vehicle and also at least one further road user are detected. In addition, the danger potential for the at least one further road user on account of the at least one vehicle is determined, and the traffic-infrastructure unit is operated as a function of the determined danger potential.

BACKGROUND INFORMATION

German Patent Application No. DE 10 2013 002 876 B4 describes a method for operating one or more illumination source(s) along at least one road provided with road illumination, the illumination sources being operated in a dimmed basic state and in at least one brighter illumination state. Via a communications link between at least one road user, which is embodied as a vehicle, in particular a motor vehicle, and at least one communications device, in particular a car-to-x communications device, that is allocated to at least one illumination source, route data that describe the further route of the road user along the at least one road are received, and the illumination sources are switched from the basic state to the illumination state as a function of the route data. Here, a characterizing feature is that the route described by the route data is subdivided into route sections or includes route points, and a probability that the road user will pass the route point or the route section is allocated to the route points and/or route sections, and a brightness of the light sources operated in the illumination state is selected as a function of the probability.

SUMMARY

An example method according to the present invention for operating a traffic-infrastructure unit that encompasses a signal source includes a step of detecting at least one vehicle, as well as a step of detecting at least one further road user. In addition, the method includes a step of determining a danger potential for the at least one further road user on account of the at least one vehicle, and a step of operating the traffic-infrastructure unit as a function of the determined danger potential.

An advantage of the method according to the present invention for operating a traffic-infrastructure unit that includes a signal source manifests itself in that a danger in the form of a danger potential is determined that may arise by an interplay between at least one vehicle and at least one further road user. The danger for the at least one further road user is able to be counteracted by operating the traffic-infrastructure unit on the basis of the determined danger potential.

The danger potential is preferably determined as a function of the position and/or the movement direction and/or the velocity of the at least one vehicle and the at least one further road user.

Factoring in the position and/or the movement direction and/or the velocity improves the quality of the determined danger potential, thereby leading to an overall improvement of the method according to the present invention because error functions are reduced or avoided on the one hand, and the operation takes place more rapidly, effectively and selectively on the other hand.

In an especially preferred specific embodiment, the traffic-infrastructure unit is operated by emitting a warning signal with the aid of the signal source encompassed by the traffic-infrastructure unit.

In an especially advantageous manner, this allows for an ad hoc and selective warning of the at least one further road user of the determined danger.

The detection of the at least one vehicle and/or the at least one further road user preferably takes place with the aid of a sensor and/or with the aid of a radio link between the at least one vehicle and the traffic-infrastructure unit and/or between the at least one further road user and the traffic-infrastructure unit.

In an especially preferred specific embodiment, the detection is realized with the aid of the radio link between the at least one road user and the traffic-infrastructure unit; this is done in such a way that the transmitting and/or receiving on the part of the at least one road user takes place with the aid of a portable transmit and receive device, in particular with the aid of a smartphone.

Many mobile transmit and receive devices, in particular smartphones, have applications such as apps, which make it possible to determine the location and/or the movement direction of the device. This results in the advantage of a detection of the at least one further road user insofar as direct access to information relating to the pose of the at least one further road user is possible, for example, and thus a more rapid and precise determination of the danger potential may take place.

The at least one further road user may preferably be a pedestrian and/or a bicyclist and/or a two-wheeled motor vehicle.

This is an advantage of the method of the present invention because in particular the road users mentioned in the previous paragraph expose themselves to an especially great danger in an interaction with at least one vehicle within a traffic scenario.

The at least one vehicle is to be understood as any vehicle that is able to use the traffic infrastructure and/or that has permission to use the traffic infrastructure. This may be both a non-automated vehicle and a semi- or fully automated vehicle. Furthermore, it may involve a four-wheeled vehicle and also a two-wheeled vehicle.

In an especially preferred specific embodiment, the emitting of the warning signal takes place in the form of an optical warning signal and/or in the form of an acoustic warning signal and/or in the form of a radio warning signal to the at least one vehicle and/or to the at least one further road user.

Preferably, the emitting of the optical warning signal is realized by modifying the illumination of the current location of the at least one further road user.

The emitting of the optical warning signal preferably takes place in such a way that the optical warning signal is emitted in the direction of the at least one vehicle.

The emitting of the optical warning signal is preferably carried out by emitting the optical warning signal in the form of signal that flashes up and down periodically and/or by emitting the optical warning signal using a wavelength range that differs from the wavelength range of an emitted non-warning signal of the signal source.

The emitting of the optical warning signal preferably takes place in that an item of information that represents the danger potential for the at least one further road user is projected onto at least a sub-region of the current location of the at least one further road user.

Different advantages for the at least one further road user are derived from the different types of the warning signal. Generally, any type of warning signal may be used on its own for operating the traffic-infrastructure unit, and it is also possible to use different combinations or all types described here jointly. In a combination of an optical and an acoustic signal, for example, it is ensured that even road users having reduced visual or auditory capabilities are warned of the danger. A signal source that emits a purely optical warning signal represents a more cost-effective alternative, for instance because a traffic-infrastructure unit may be utilized that is already equipped with an illumination source. A purely optical signal source offers the advantage that it operates independently of the brightness of the environment and thus may also be utilized to the full extent under light conditions that are difficult for the method according to the present invention.

The traffic-infrastructure unit according to the present invention includes a signal source as well as first means for detecting at least one vehicle, and second means for detecting at least one further road user. Moreover, third means for determining a danger potential for the at least one further road user on account of the at least one vehicle, and fourth means for operating the traffic-infrastructure unit as a function of the determined danger potential are included.

The signal source and/or the first means and/or the second means and/or the third means and/or the fourth means is/are developed for executing a method as recited in at least one of the method claims.

In an especially preferred specific embodiment, the traffic-infrastructure unit is a streetlight.

Advantageous further refinements of the present invention are described herein.

BRIEF DESCRIPTION OF THE DRAWINGS

Exemplary embodiments of the present invention are shown in the figures and are described in greater detail below.

Of course, still further exemplary embodiments and mixed forms of the illustrated examples are possible as well.

DETAILED DESCRIPTION OF EXAMPLE EMBODIMENTS

Figure 1:
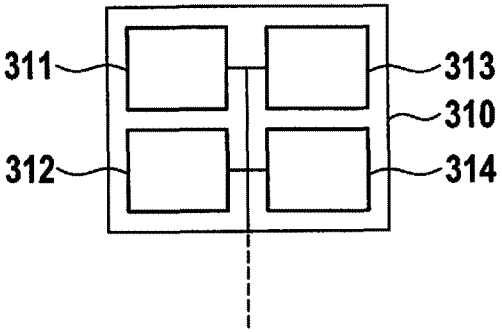
FIG. 1 shows, purely by way of example, a device of the traffic-infrastructure unit, which includes the means according to the present invention for executing the method of the present invention.

FIG. 1 shows a device (310), which includes a first means (311) for detecting at least one vehicle (100), a second means (312) for detecting at least one further road user (200), a third means (313) for determining a danger potential for the at least one further road user (200) on account of the at least one vehicle (100), and a fourth means (314) for operating the traffic-infrastructure unit (300) as a function of the determined danger potential.

Figure 2:
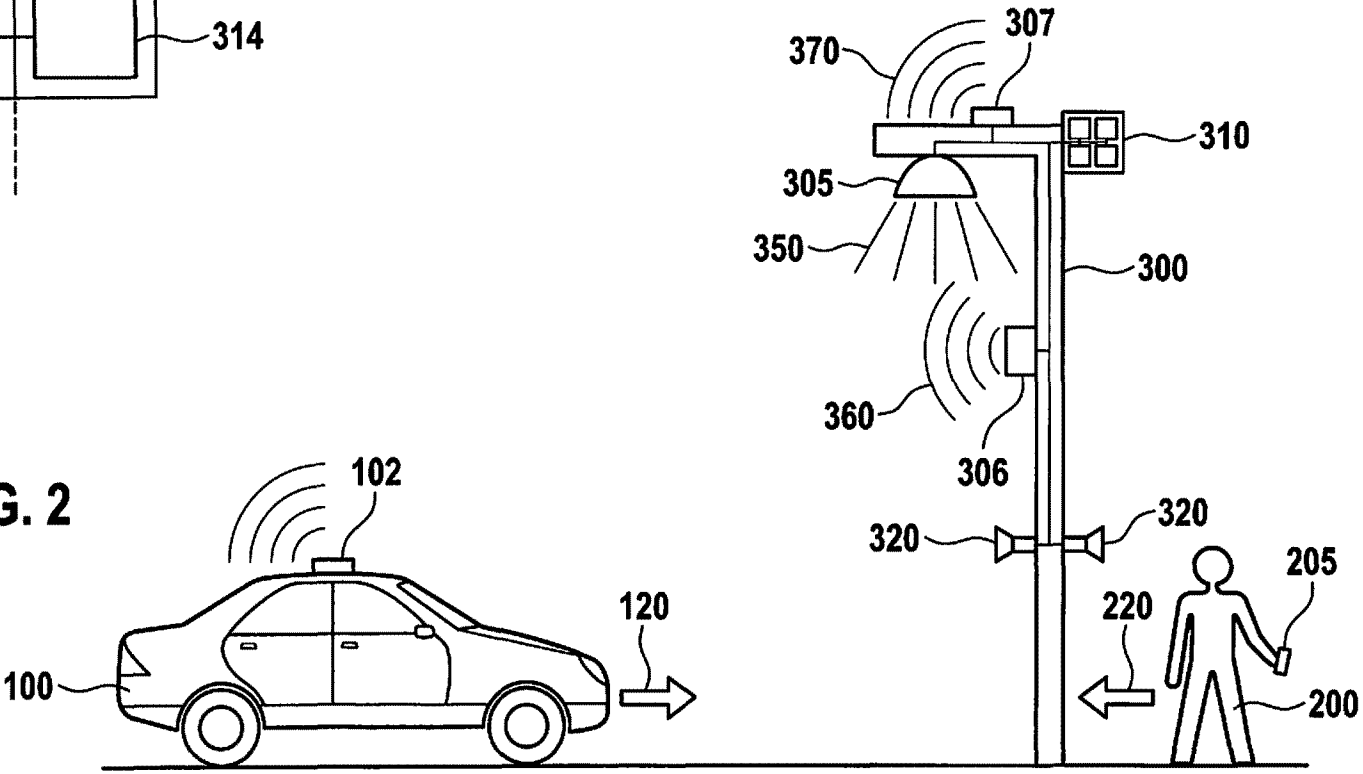
FIG. 2 shows, purely by way of example, an exemplary embodiment.

This device (310) is part of a traffic-infrastructure unit (300) as it is shown in FIG. 2 on the basis of an exemplary embodiment.

The first means (311) are developed in such a way that they detect at least one vehicle (100) by either having access to at least one sensor (320), which is also mounted on the traffic-infrastructure unit (300), or by having at least one sensor (320). The at least one sensor, for example, may be a video, radar or lidar sensor. In addition, it is also possible to use a plurality of sensors of the same and/or different type, which supplement one another and/or plausibilize one another, for instance. A video sensor may be both a mono and a stereo camera.

The first means (311) furthermore include an image-processing system which encompasses a processor, a working memory and a hard disk, for example; in addition, a program is stored, which is set up to analyze images so that a vehicle (100) is able to be identified and thus detected according to the method of the present invention. The exact identification may be carried out with the aid of programs for an object classification, for instance.

The second means (312) are developed in such a way that they detect at least one further road user (200). For example, this may be done in that they also have access to at least one sensor (320) mounted on the traffic-infrastructure unit (300), have at least one sensor of their own, or have access to sensors of the first means (311). Specifications that match those for the first means (311) apply to the second means (312) as far as both the development and the number of sensors used are concerned. The same is true for the image-processing system and thus for the procedure of the object identification.

Moreover, the second means (312), for example, are also developed in such a way that they detect the at least one further road user (200) with the aid of a signal that originates from a mobile transmit and receive device (205), which is carried by the road user. Toward that end, the second means (312) may access a receive and transmit unit (307) of the traffic-infrastructure unit (300), for example, or also include its own transmit and receive unit. The mobile transmit and receive unit may be a smartphone, for example, or a device specifically provided for this purpose, which is able to be purchased and carried along for the purpose of executing the method of the present invention. The use of a smartphone (205) is possible by installing an application on the smartphone provided specifically for this purpose, which—having the corresponding rights—continually transmits the position (210) of the at least one further road user (200) to the traffic-infrastructure unit (300) provided toward that end, or to the second means (312). For example, this may be accomplished in that only traffic-infrastructure units (300) within a predefined radius are able to receive the signals from the smartphone (205).

In addition, it is possible that the first means (311) and the second means (312) involve the same means because their methods of functioning include comparable method steps.

The third means (313) are designed to determine a danger potential for the at least one further road user (200) that emanates from the at least one vehicle (100). For example, this may be accomplished in that the positions (110, 210) of the at least one vehicle (100) and the at least one further road user (200) as well as their movement directions (120, 220) are analyzed. To do so, both the positions (110, 210) and the movement directions (120, 220) are able to be plotted in the form of vectors in a two-dimensional system such as a map. The positions (110, 210) specify the starting points of the vectors and the movement directions (120, 220) specify the propagation direction of the vectors. In connection with the velocity of the at least one vehicle (100) and the velocity of the at least one further road user (200), it is now possible to define a danger potential, for instance by calculating how closely the two will approach each other provided no changes occur in the movement directions (120, 220) and/or the velocities.

In the process, the danger potential may be determined to be high if either a collision or a near-collision is to be expected. In the latter case, for example, the at least one vehicle (100) and the at least one further road user come so close to each other that a collision becomes highly likely in a small deviation of the movement directions (120, 220).

An average danger potential is present, for example, if no actual collision is to be expected but such a collision can also not be completely ruled out due to the expected trajectories.

A small danger potential is present, for instance, if no actual collision is to be expected yet such a collision is still possible if one of the movement directions (120, 220) changes drastically, for example.

No danger potential is present if a collision can be ruled out completely.

Predefined distance and/or velocity values, which allow a classification when exceeded or undershot, for example, may be utilized for the precise evaluation or classification of the danger potential.

The third means (313) include a processor, a working memory and a hard disk, for example, for determining the danger potential. It is also possible that the third means (313) shares the processor and/or the working memory and/or the hard disk with the first means (311) and/or the second means (312).

The fourth means (314) are designed to operate the traffic-infrastructure unit (300) as a function of the determined danger potential. The fourth means (314), for example, receive the positions (110, 210) and/or the movement directions (120, 220) of the at least one vehicle (100) and the at least one further road user (200) as well as the information as to how these data were acquired, for example. It is now possible to output a warning signal (350, 360, 370) that emanates from the traffic-infrastructure unit (300) as a function of these data as well as of the danger potential. In the event that the at least one further road user (200) was detected by a sensor (320), for example, an optical warning signal (350) and/or an acoustic warning signal may be emitted. If the at least one further road user (200) was detected by smartphone (205), it is possible to emit a radio signal (370), which is received by the smartphone (205) and is displayed as a corresponding warning. Instead of a smartphone, any other transmit and receive device (205) equipped with an appropriate output unit may in principle be used as well.

In addition, the fourth means (314) are developed in such a way that they have access to the corresponding transmit and/or receive unit (305, 306, 307) of the traffic-infrastructure unit (300) for the emission of an optical warning signal (350) and/or an acoustic warning signal (360) and/or a radio signal (370). To do so, the fourth means (314) include a corresponding control unit which is able to actuate the first means (311), the second means (312) and the third means (313) as a function of the received data of said means.

For example, the transmit units (305, 306) for emitting an optical warning signal or an acoustic warning signal are developed in such a way that they are disposed in a pivotable manner so that a selective emission of the warning signal (350, 360) is possible.

FIG. 2 shows an exemplary embodiment of the method according to the present invention. Here, a vehicle (100) approaches traffic-infrastructure unit (300) and an oncoming pedestrian (200). The vehicle (100) shown here is equipped with a transmit and receive unit (102), which makes it possible not only to transmit both its position (110) and its movement direction (120) to traffic-infrastructure unit (300) but also to receive data from traffic-infrastructure unit (300). The pedestrian (200) carries a smartphone, on which an application is stored which allows the traffic infrastructure unit (300) to receive the position (210) as well as the movement direction (220).

In addition, FIG. 2 shows a traffic-infrastructure unit (300), which encompasses device (310) having first means (311), second means (312), third means (313), and fourth means (314). Moreover, traffic-infrastructure unit (300) includes transmit and receive units (305, 306, 307) which are designed to emit optical warning signals (350), acoustic warning signals (360), and radio warning signals (370). Traffic-infrastructure unit (300) also includes sensors (320), which are designed to detect the vehicle and/or the pedestrian.

The exemplary embodiment depicted here shows a vehicle (100) and a further road user (200), which in this case is a pedestrian. A plurality of vehicles (100) may also be involved, which, for instance, all approach further road user (200) in such a way that each one of them individually poses a danger for further road user (200). Traffic-infrastructure unit (300) may for this purpose also be equipped with a plurality of signal sources of the same type such as a plurality of optical signal sources. In addition, it may also be the case that a plurality of further road users (200) are involved in that, for example, a vehicle (100) approaches a plurality of further road users (200) such as pedestrians and/or bicyclists and/or riders of two-wheeled vehicles, in such a way that this vehicle (100) poses a danger to all further road users (200). The danger potential is determined separately for each further road user (200), after which a warning is generated in accordance with the classification of the danger. For example, this may be a selective acoustic warning signal for a pedestrian and, simultaneously, an optical warning signal for the rider of a two-wheeled motor vehicle inasmuch as it has to be assumed on account of the helmet that an acoustic warning signal would be less effective than an optical warning signal. Of course, it may also be the case that a plurality of vehicles (100) and a plurality of further road users (200) are involved.

Figure 3:
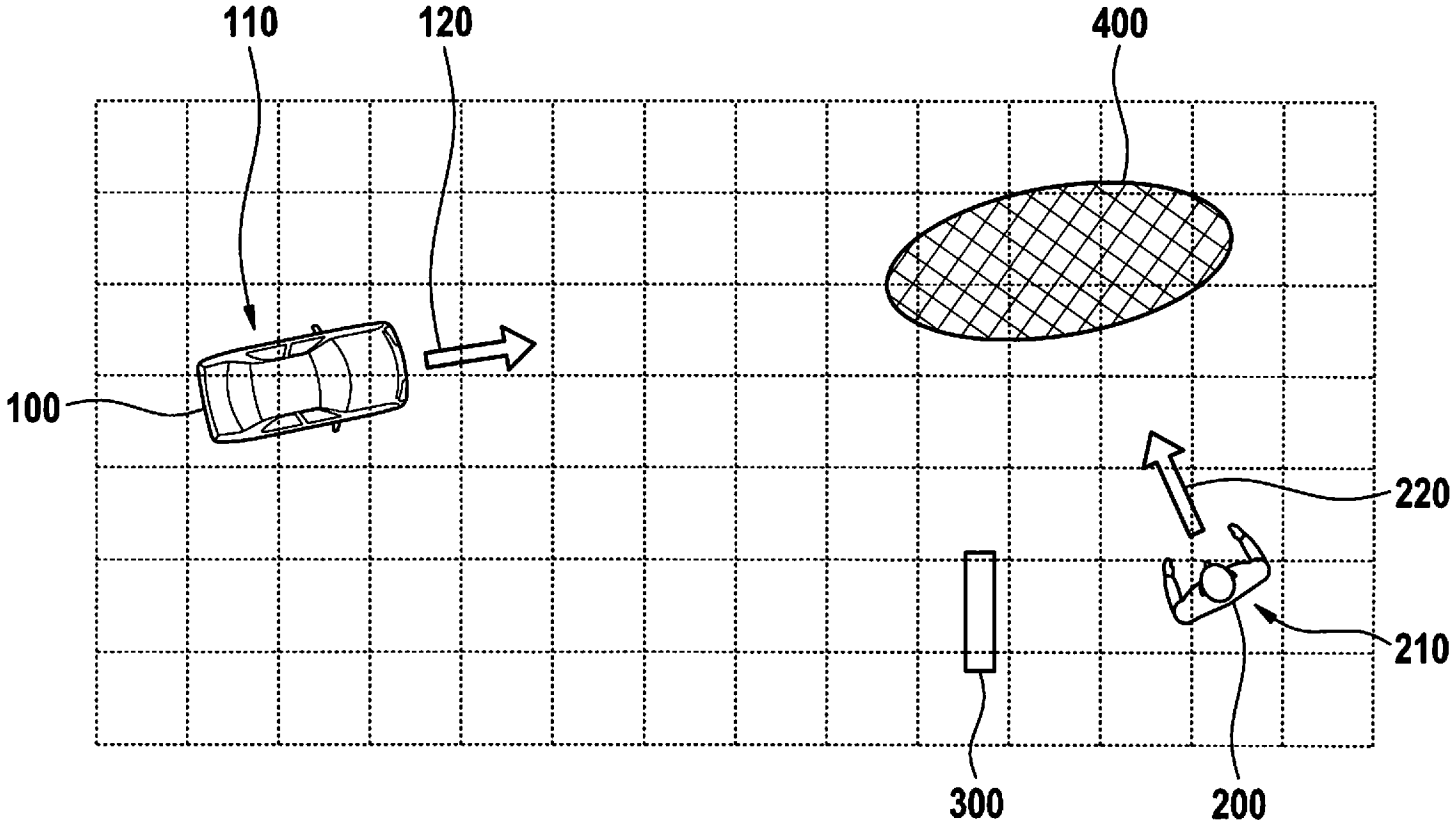
FIG. 3 shows, purely by way of example, an exemplary embodiment in the form of a schematic illustration.

FIG. 3 shows an exemplary embodiment by which the determination of the danger potential is explained with the aid of a schematic representation. Here, a vehicle (100) approaches a pedestrian (200). Both are detected by traffic infrastructure unit (300) with the aid of the first means (311) and with the aid of the second means (312).

In this example, both the position (110) and the movement direction (120) of the vehicle (100) as well as the position (210) and the movement direction (220) of the further road user (200) are entered into a map that includes a coordinate system such that values are able to be allocated to each position (110, 210) and to each movement direction (120, 220). For example, together with velocity values, these values allow for the calculation of a time-based trajectory for the vehicle (100) and for the further road user (200) in such a way that it is able to be determined whether the vehicle (100) and the further road user come so close to each other that vehicle (100) poses a danger for further road user (200). Here, the potential region in which the vehicle (100) and further road user (200) could encounter each other is also indicated on the map, in the form of marked area (400). In this particular example, this marked area (400) not only exists, so that the further road user (200) is at risk, but it is also relatively small in comparison with the vehicle (100) and/or the further road user, which suggests a high danger potential. If the potential area is markedly larger, the likelihood that the vehicle (100) and the further road user will make direct contact is correspondingly lower, and the danger potential could then be classified as average. Additional decision criteria are possible in this context, which may be stored in the third means (313), for instance in the form of predefined parameters.

Figure 4:
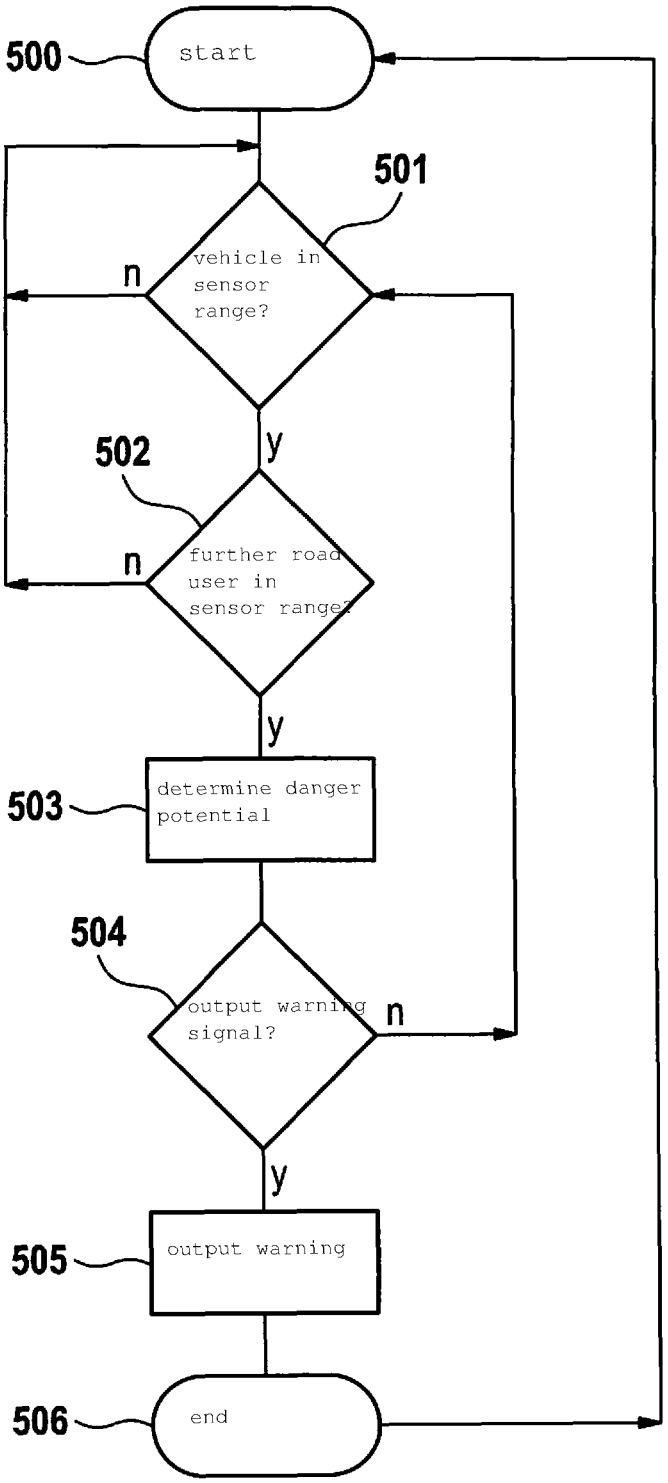
FIG. 4 shows, purely by way of example, an exemplary embodiment in the form of a flow diagram of the method according to the present invention using the devices according to the present invention.

FIG. 4 shows an exemplary embodiment of the method of the present invention in the form of a flow diagram.

The method starts in step 500.

In step 501, the first means (311) of the device (310) of a traffic-infrastructure unit (300) detects whether a vehicle (100) is located within the sensor range of the traffic-infrastructure unit (300). This is done with the aid of an optical sensor (320), for example. In the process, a first image is recorded and it is determined with the aid of a corresponding program whether a vehicle (100) is located within the range of the sensor of traffic-infrastructure unit (300). If a vehicle (100) is located in the sensor range of traffic-infrastructure unit (300), step 502 follows. The method is started anew if no vehicle (100) is present in the sensor range.

In step 502, it is detected with the aid of second means (312) of the device (310) of traffic-infrastructure unit (300) whether a further road user (200) is located in the sensor range of traffic-infrastructure unit (300). For instance, this is a pedestrian carrying a smartphone. This smartphone has an application which allows the exchange of data with a transmit and receive unit (307) of traffic-infrastructure unit (300). In the process, the application permanently transmits both the position (210) and the movement direction (220) of the smartphone to traffic-infrastructure unit (300). If a further road user (200) is located within the sensor range of traffic-infrastructure unit (300), step 503 will follow. The method starts anew if no further road user (200) is located within the sensor range.

In step 503, third means (313) of the device (310) is used to determine whether vehicle (100) represents a danger potential for further road user (200).

In step 504, traffic-infrastructure unit (300) is operated by fourth means (314) of the device (310) in such a way that depending on the danger potential determined in step (503), a warning signal (305, 306, 307) is either outputted or not outputted. If no warning signal (305, 306, 307) is outputted, for instance because the distance between the vehicle (100) and the further road user (200) is too great or the danger potential too low for the existence of a danger for further road user (200), then step 501 will follow. If a warning signal (305, 306, 307) is outputted, then step 505 follows.

In step 505, an optical warning signal (305) and/or an acoustic warning signal (306) and a radio signal is/are outputted as a function of the determined danger potential and as a function of the vehicle (100) and the further road user (200), for instance depending on whether a pedestrian or a bicyclist is involved, such that the vehicle (100) and/or the further road user (200) will be warned. Step 506 follows.

The method ends in step 506.

As a whole, the method runs in a permanent loop, for instance. As a result, the danger potential and thus the warning signal (305, 306, 307) that depends thereon, are able to be constantly adapted until the danger has been averted or the vehicle (100) and/or the further road user (200) are no longer able to be detected.

What is claimed is:

1. A method for operating a traffic-infrastructure unit including at least one signal source, the method comprising:

detecting at least one vehicle;

detecting at least one further road user;

determining, by the traffic-infrastructure unit, a danger potential for the at least one further road user on account of the at least one vehicle based on the detecting of the at least one vehicle and the detecting of the at least one further road user; and operating the traffic-infrastructure unit as a function of the determined danger potential, wherein the operation of the traffic-infrastructure unit includes the traffic-infrastructure unit modifying, as a function of the determined danger potential, an illumination of a current location of the at least one further road user via a light source of the traffic-infrastructure unit, the light source being external to the at least one further road user and to the at least one vehicle;

wherein the traffic-infrastructure unit is a stationary, fixed in place traffic-infrastructure unit.

2. The method as recited in claim 1, wherein the danger potential is determined, by the traffic-infrastructure unit, as a function of at least one of a position, a movement direction, and a velocity, of the at least one vehicle and the at least one further road user.

3. The method as recited in claim 1, wherein the detection of at least one of the at least one vehicle and the at least one further road user takes place at least one of: (i) with the aid of a sensor, (ii) with the aid of a radio link between the at least one vehicle and the traffic-infrastructure unit, and (iii) between the at least one further road user and the traffic-infrastructure unit.

4. The method as recited in claim 3, wherein the detection is realized with the aid of the radio link between the at least one road user and the traffic-infrastructure unit in such a way that at least one of a transmitting and a receiving, on the part of the at least one road user, takes place with the aid of a portable transmit and receive device, the portable transmit and receive device being a smartphone.

5. The method as recited in claim 1, wherein the at least one further road user includes at least one of a pedestrian, a bicyclist, and a two-wheeled motor vehicle.

6. The method as recited in claim 1, wherein the traffic-infrastructure unit is a street light.

7. A method for operating a traffic-infrastructure unit including at least one signal source, the method comprising:

detecting, by the traffic-infrastructure unit, a vehicle;

receiving, by the traffic-infrastructure unit, information regarding a further road user transmitted from a transmit and receive unit of the further road user, the information regarding the further road user including at least one of a position of the further road user and a movement direction of the further road user;

determining, by the traffic-infrastructure unit, a danger potential for the at least one further road user on account of the vehicle, based on the detecting of the vehicle and based on the received information regarding the further road user; and operating the traffic-infrastructure unit as a function of the determined danger potential;

wherein the traffic-infrastructure unit is a stationary, fixed in place traffic-infrastructure unit.

8. The method as recited in claim 7, wherein the operation of the traffic-infrastructure unit including emitting, as a function of the determined danger potential, a warning signal with the aid of the at least one signal source encompassed by the traffic-infrastructure unit.

9. The method as recited in claim 8, wherein the emitting of the warning signal, as a function of the determined danger potential, takes place in the form of the optical warning signal, the emitting of the optical warning signal taking place in such a way that an item of information that represents the danger potential for the at least one further road user is projected onto at least a sub-region of the current location of the at least one further road user.

10. The method as recited in claim 8, wherein the emitting of the warning signal, as a function of the determined danger potential, takes place in the form of the optical warning signal, the emitting of the optical warning signal taking place in such a way that at least one of: (i) the optical warning signal is emitted in the form of a signal that periodically flashes up or down, and (ii) the optical warning signal is emitted in a wavelength range that differs from the wavelength range of an emitted non-warning signal of the signal source.

11. The method as recited in claim 8, wherein the emitting of the warning signal, as a function of the determined danger potential, takes place in the form of the optical warning signal, the emitting of the optical warning signal taking place in such a way that the optical warning signal is emitted in the direction of the at least one vehicle.

12. The method as recited in claim 8, wherein the emitting of the warning signal, as a function of the determined danger potential, takes place in the form of the optical warning signal, the emitting of the optical warning signal taking place in such a way that illumination of a current location of the at least one further road user is modified.

13. The method as recited in claim 8, wherein the emitting of the warning signal, as a function of the determined danger potential, takes place at least one of: (i) in the form of an optical warning signal, (ii) in the form of an acoustic warning signal, and (iii) in the form of a radio warning signal, wherein the emitting of the warning signal is one of: (i) to the at least one vehicle, and (ii) to the at least one further road user.

14. The method as recited in claim 7, wherein the detecting of the vehicle include receiving information regarding the vehicle transmitted from a transmit and receive unit of the vehicle, the information regarding the vehicle including at least one of a position of the vehicle and a movement direction of the vehicle, and wherein the danger potential is determined as a function of the received information regarding the vehicle and the receiving information regarding the further road vehicle.

15. The method as recited in claim 7, wherein the traffic-infrastructure unit is a street light.

16. The method as recited in claim 7, wherein the transmit and receive unit of the further road user is part of a smartphone.

17. The method as recited in claim 7, wherein the danger potential is determined, by the traffic-infrastructure unit, as a function of at least one of a position, a movement direction, and a velocity, of the vehicle and the further road user.

18. A traffic-infrastructure unit, comprising:

a signal source; and a device that encompasses:

first means for detecting at least one vehicle;

second means for detecting at least one further road user;

third means for determining a danger potential for the at least one further road user on account of the at least one vehicle based on the detecting of the at least one vehicle and the detecting of the at least one further road user; and fourth means for operating the traffic-infrastructure unit as a function of the determined danger potential, wherein the operation of the traffic-infrastructure unit includes the traffic-infrastructure unit modifying, as a function of the determined danger potential, an illumination of a current location of the at least one further road user via a light source of the traffic-infrastructure unit, the light source being external to the at least one further road user and to the at least one vehicle;

wherein the traffic-infrastructure unit is a stationary, fixed in place traffic-infrastructure unit.

19. The traffic-infrastructure unit as recited in claim 18, wherein at least one of the signal source, the first means, the second means, third means, and/or the fourth means are designed determine the danger potential as a function of at least one of a position, a movement direction, and a velocity, of the at least one vehicle and the at least one further road user.

20. The traffic-infrastructure unit as recited in claim 18, wherein the traffic-infrastructure unit is a street light.

* * * * *